US005620583A

United States Patent [19]

Kuhn et al.

[11] Patent Number: 5,620,583

[45] Date of Patent: Apr. 15, 1997

[54] PLATINUM PLATING BATH

[75] Inventors: Werner Kuhn, Rodenbach; Wolfgang Zilske, Hanau, both of Germany

[73] Assignee: Degussa Aktiengesellschaft, Frankfurt am Main, Germany

[21] Appl. No.: 624,806

[22] Filed: Mar. 27, 1996

[30] Foreign Application Priority Data

Apr. 15, 1995 [DE] Germany ..... 195 14 253.5
Dec. 21, 1995 [DE] Germany ..... 195 47 900.9

[51] Int. Cl.[6] ..... C25D 3/52

[52] U.S. Cl. ..... 205/264; 205/260; 205/259; 106/1.28

[58] Field of Search ..... 205/257, 259, 205/260, 264; 106/1.28

[56] References Cited

U.S. PATENT DOCUMENTS 2,984,604 5/1961 Duva et al. ..... 205/264
5,102,509 4/1992 Albon et al. ..... 205/257

*Primary Examiner*—Kathryn Gorgos
*Assistant Examiner*—Kishor Mayekar
*Attorney, Agent, or Firm*—Beveridge, DeGrandi, Weilacher & Young, L.L.P.

[57] ABSTRACT

Crack-free, bright platinum layers with thicknesses of more than 100 μm are obtained from electroplating baths which contain 5 to 30 g/l platinum as amminesulphamato complex and 20 to 400 g of a strong acid if the content of free amidosulphuric acid amounts to less than 5 g/l.

10 Claims, No Drawings

PLATINUM PLATING BATH

The present invention relates to a platinum plating bath, in particular for the electrodeposition of thick layers of platinum, which contains 5 to 30 g/l platinum in the form of amminesulphamato complex and has a pH value of less than 1. In another aspect, the invention relates to a platinum plating method whereby thick, bright and crack-free platings can be obtained.

As is known in the art for the electroplating deposition of platinum, typically use is made of acid and alkaline baths based on platinum(II) and platinum(IV) compounds. The most important types of baths contain diamminedinitritoplatinum(II) (P salt), sulphatodinitritoplatinum acid (DNS) or hexahydroxoplatinum acid, or the alkaline salts thereof. The stated types of bath are predominantly suitable only for the deposition of thin platinum layers amounting to a few μm. The deposition of thicker layers for industrial applications is generally a problem with platinum. Either the layers have high internal stress, become cracked and even break open, or the electrolytes are not sufficiently stable and decompose relatively quickly in the course of the long electrolysis-times.

It is known from DE-PS 11 82 924 to provide an acid bath for the electroplating deposition of platinum coatings which consists of an aqueous solution of a complex dinitroplatinate(II) compound having a pH value below 2. By way of complex platinum compound, the dinitrosulphamato complex may also be used. According to the stated details, with these platinum baths layer thicknesses of only up to 25 μm are obtained. Layers amounting to more than 25 μm have a tendency to crack and are therefore unsuitable for many applications.

In DE-PS 12 56 992 a platinum plating bath is described which consists of an aqueous solution of platinum diamminedinitrite (P salt) and alkaline salts of sulphamic acid. It is recommended to operate this bath at pH values of 6.5 to 8. Here too, according to the stated details, layer thicknesses of only up to about 20 μm are obtained. However, the pH value must be kept constant within narrow limits. With pH values below 3 the platinum layer will be detached.

According to DE-AS 11 44 074 the P salt is caused to react with a high excess of sulphamic acid, $NH_2SO_3H$, so that after dilution with water a bath is obtained which is ready for use and which contains 6–20 g/l platinum and 20–100 g/l sulphamic acid (amidosulphuric acid). However, this electrolyte is only stable as long as the bath is in operation. Thick layers that are free from cracks can only be obtained with a matt surface.

An object of the present invention is to develop a platinum plating bath and method, in particular for the deposition of thick layers, which contains 5 to 30 g/l platinum in the form of the amminesulphamato complex and has a pH value of less than 1, and which is capable of forming layer thicknesses greater than 100 μm that are free from cracks, and are smooth and bright.

A further object is to provide baths that are also stable when not in use.

SUMMARY OF THE INVENTION

The above and other objects are achieved in accordance with the invention by using an electrolyte containing at most 5 g/l free amidosulphuric acid (sulphamic acid) and 20 to 400 g/l of a strong acid with a pH value less than 1. This is combined with the platinum; e.g., 5 to 30 g/l as the amminesulphamato complex.

As strong acid, sulphuric acid, methanesulphonic acid or perchloric acid is preferably used. In addition, other mineral acids may be used such as fluorosulphuric acid or fluoroboric acid, alkanesulphonic acids such as methanedisulphonic acid, ethanesulphonic acid, hydroxyethanesulphonic acid and homologues, or perfluorinated alkanesulphonic acids such as trifluoromethanesulphonic acid or pentafluoroethanesulphonic acid, and perfluorocarboxylic acids such as trifluoroacetic acid.

Moreover, it is advantageous if the electrolyte additionally contains 0.01 to 0.2 g/l of a fluorine-based surfactant by way of wetting agent. Surfactants of this type are known in the art and any suitable ones may be used.

It has proved useful if as amminesulphamato complex the product of the reaction of 1 mol P salt (platinum-diamminedinitrito complex) with 4 to 6 mol amidosulphuric acid is used.

By using these platinum plating baths as described herein, thick coatings of 100 μm or more can be obtained. The coatings produced in accordance with this invention are bright and crack free.

DETAILED DESCRIPTION OF INVENTION

According to a more detailed description of the invention, very good deposition results are obtained if the platinum P salt is caused to react with amidosulphuric acid in equivalent quantities and the resulting platinum-sulphamato complex solution is added to an aqueous solution of a strong acid. Preferably, the acid may be, for example, sulphuric acid, methanesulphonic acid or perchloric acid. In this regard the bath must contain a sufficient quantity of the strong acid. Quantities of 20 to 400 g/l have proved useful.

The bath may in addition contain 0.01–0.2 g/l of a fluorine-based surfactant with a view to suppressing spray mists. In carrying out the method of the invention, the plating is conducted at a temperature between 60° and 90° C. and with electric current densities of 1–4 A/dm$^2$. The plating process is carried out for a sufficient period of time to form a platinum layer of desired thickness; e.g., at 100 μm. Typically, an article having a surface capable of having a platinum layer deposited thereon is placed in the bath and then the plating process is carried out. The article can later be dissolved, for example, to form a platinum foil.

The platinum-amminesulphamato complex solution has proved to be surprisingly stable in the strongly acid bath without free amidosulphuric acid. Even with long electrolysis-times the bath showed no formation of any precipitate. Sulphamate that is liberated in the course of deposition of the platinum is quickly hydrolysed and does not accumulate in the electrolyte.

The platinum coatings deposited from these baths are free from cracks. They are also bright and ductile, even in the case of layer thicknesses of over 100 μm.

The following example shows the advantages of the bath according to the invention:

A platinum plating bath is prepared in the following way: 80 ml sulphuric acid (97%) are diluted in about 600 ml water. To this solution there are added 16 g platinum in the form of the platinum-amminesulphamato complex solution and 0.1 g of a fluorine-based surfactant. After topping-up with water, a 1-liter bath is obtained that is ready for use. At a bath temperature of 80° C. and with a current density of 2 A/dm$^2$ a part made of silver is coated in the course of rotary movement. After about 13 hours an approximately 120 μm thick, bright platinum layer has been evenly deposited. After dissolving the silver out with nitric acid, diluted 1:1, a stable, crack-free platinum foil is obtained.

Further variations and modifications of the foregoing will be apparent to those skilled in the art and one intended to be encompassed by the claims appended hereto.

German priority applications 195 14 253.5 and 195 47 900.9 are relied on and incorporated herein by reference.

We claim:

1. A platinum electroplating bath, for depositing thick layers of platinum, comprising 5 to 30 g/l platinum ions as amminesulphamato complex, 20 to 400 g/l of an acid of sufficient strength to create a pH value less than 1 in said electroplating bath, and at most 5 g/l free amidosulphuric acid.

2. The platinum electroplating bath according to claim 1, wherein said acid is a member selected from the group consisting of sulphuric acid, methanesulphamic acid and perchloric acid.

3. The platinum electroplating bath according to claim 2, further comprising 0.01 to 0.2 g/l of a fluorine-based surfactant as a wetting agent.

4. The platinum electroplating bath according to claim 1, further comprising 0.01 to 0.2 g/l of a fluorine-based surfactant as a wetting agent.

5. The platinum electroplating bath according to claim 1, wherein said amminesulphamato complex is a product resulting from a reaction of 1 mol diamminedinitritoplatinum(II) with 4 to 6 mol amidosulphuric acid.

6. The platinum electroplating bath according to claim 5, wherein said diamminedinitritoplatinum(II) is reacted with said amidosulphuric acid in equivalent quantities to form said amminesulphamato complex.

7. A method of making a platinum electroplating bath comprising adding a platinum amminesulphamato complex solution to an aqueous bath of an acid of sufficient strength to create a pH value of less than 1 in said bath, optionally adding a fluorine-based surfactant, and adding water so the pH of said bath is less than 1; said bath contains at most 5 g/l free amidosulphuric acid.

8. A method of electroplatingly depositing platinum on an article comprising placing said article in a platinum electroplating bath comprising 5 to 30 g/l platinum ions as amminesulphamato complex, 20 to 400 g/l of an acid sufficient to create a pH value less than 1 in said electroplating bath, and at most 5 g/l free amidosulphuric acid, subjecting said bath to a temperature of between 60° and 90° C. and operating said electroplating bath at an electric current density of 1 to 4 $A/dm^2$ for a sufficient period of time to deposit a bright layer of platinum on said article.

9. The method according to claim 8 further comprising dissolving said article to obtain a platinum foil.

10. The method according to claim 8 wherein said period of time is sufficient to deposit the layer of platinum of at least 100 μm thickness.

* * * * *